US007458658B2

(12) United States Patent
Chang et al.

(10) Patent No.: US 7,458,658 B2
(45) Date of Patent: Dec. 2, 2008

(54) PRINTING METHOD

(75) Inventors: Chia-Ming Chang, Taipei County (TW); Chao-Kai Cheng, Hsinchu County (TW); Chih-Jian Lin, Taipei County (TW); Chih-Hsuan Chiu, Taipei County (TW); Chun-Hung Liu, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 3 days.

(21) Appl. No.: 11/690,134

(22) Filed: Mar. 23, 2007

(65) Prior Publication Data

US 2008/0106573 A1 May 8, 2008

(30) Foreign Application Priority Data

Nov. 8, 2006 (TW) ..... 95141296 A

(51) Int. Cl.
*B41J 2/145* (2006.01)
*B41J 2/15* (2006.01)

(52) U.S. Cl. ..... 347/41; 347/20

(58) Field of Classification Search ..... 347/40–43, 347/20

See application file for complete search history.

(56) References Cited

U.S. PATENT DOCUMENTS 5,924,804 A * 7/1999 Hino et al. ..... 400/118.2
6,183,063 B1 * 2/2001 Bolash et al. ..... 347/42
6,328,418 B1 * 12/2001 Yamada et al. ..... 347/40
6,663,222 B2 * 12/2003 Verhoest et al. ..... 347/40

FOREIGN PATENT DOCUMENTS

WO 0250260 A2 6/2002
WO 02098573 A1 12/2002
WO 02098575 A1 12/2002

OTHER PUBLICATIONS

Article Titled "Dynamic Management for Multiple Rotation Print Heads with Interlace Print Part I: Flow & Memory Arbitration",jointly authored by Chang et al., International Conference on Digital Printing Technologies,Sep. 17-22, 2006, pp. 19-21,2004-5 The Society for Imaging Science and Technology, Springfield, USA.

* cited by examiner

*Primary Examiner*—Thinh H Nguyen
(74) *Attorney, Agent, or Firm*—Jianq Chyun IP Office

(57) ABSTRACT

A printing method is provided. In the printing method, a printing head is rotated with an angle, such that all the nozzles of the printing head are aligned with the dots of the data to be printed. After being rotated, the printing head performs the printing. If some nozzles of the printing head cannot be aligned with the dots of the data to be printed after the printing head is rotated, the resolution of the data to be printed is increased to solve the misalignment.

19 Claims, 6 Drawing Sheets

PRINTING METHOD

CROSS-REFERENCE TO RELATED APPLICATION

This application claims the priority benefit of Taiwan application serial no. 95141296, filed Nov. 8, 2006. All disclosure of the Taiwan application is incorporated herein by reference.

BACKGROUND OF THE INVENTION

1. Field of Invention

The present invention relates to a printing method, and more particularly to a printing method used when the resolution of a printing data is different from the distance between nozzles of a printing head.

2. Description of Related Art

When a printing method is used in industry to form an expected structure, the resolution of printing always changes with different application ranges, thus when a printing head of a fixed resolution is used for printing, the requirement on various printing resolutions cannot be satisfied. In order to solve this problem, various printing heads of different resolutions must be prepared for being replaced according to the different resolutions of the data to be printed. Thereby, the manufacturing cost and the process time for replacing the printing head are both increased. Moreover, whether a fitting printing head is available is another problem.

Moreover, the PCT Patent Application No. WO 02/098575 has disclosed a method of improving the printing quality of a microdeposition. The application is directed to controlling the ink drop size by the way of controlling the waveform of each nozzle or adjusting the drop number. Meanwhile, the resolution in the horizontal direction is increased by the way of generating an over-clocking signal with a control unit, and frequency division is performed by the way of adjusting the printing velocity of the printing head so as to achieve the goal of adjusting the resolution in the horizontal direction.

For example, FIG. 1A shows incorrect driving waveforms 370-1, 370-2, and 370-8 of the printing head, which cause the sizes or displacements of positions of a part of the corresponding ink drops 374-1, 374-2, . . . and 374-8 having errors. For example, the ink drop 374-4 is too small and incorrect in position, the ink drop 374-2 is too large and is also incorrect in position. By rotating the angle of a PMD printing head and adjusting the operation clock, as shown in FIG. 1B, correct driving waveforms 380-1, 380-2, . . . and 380-8 of the printing head and correct sizes and positions of the ink drops 384-1, 384-2, . . . and 384-8 are obtained.

Moreover, the PCT Patent Application No. WO 02/050260 has disclosed a microdeposition system, which is used to jet print a specific pattern on a substrate, and eliminates the defect of non-uniform density distribution due to the abnormal operation of nozzles. The patent application discloses that a mask is generated for jet printing a specific pattern, which is needed in the calculation of each jet printing process to calculate the data to be jet printed this time, so as to eliminate the defect of the non-uniform density distribution due to the abnormal operation of nozzles. FIG. 2A is a pattern to be formed, and a printing head 50 of FIG. 2B jets ink drops of predetermined positions in a plurality of rows 206-1 to 206-B according to nozzles 134-1 to 134-*n*. In the microdeposition system disclosed in this patent application, as shown in FIG. 2C, the pattern to be formed is obtained by a plurality of movements (as shown by marks 210 and 240) of the printing head 50 according to a mask generated by a mask generating device.

Moreover, in the PCT Patent Application No. WO 02/098573, a control unit is used to produce a jet printing waveform command, and send the command to the nozzle on the printing head, so as to produce the expected printed pattern, and the resolution of the printed image file is adjusted by the printing method of rotating the printing head. When a command of needing a nozzle to jet print is sent out by the control unit, a digital to analog converter (DAC) program device communicates with a memory and a controller, and produces a waveform voltage value to the nozzle. After receiving the voltage waveform, an OP amplifier corresponding to the nozzle performs the jet printing action.

FIG. 3 is a relative position of nozzles of a printing head and dots of a data to be printed according to a conventional printing method. As shown in FIG. 3, when the data with different resolutions needs to be printed, the printing resolution is changed by rotating the printing head. In FIG. 3, the printing head has nine nozzles, and after the printing head is rotated with an appropriate angle, each nozzle is aligned with a row of the dots. However, only three in nine nozzles are completely aligned with the dots. In other words, every time the printing head jets, only three nozzles functions instead of performing a full-hole jet printing. Thereby, the time for printing is increased. Moreover, it is needed to fill blank dots to the nozzles which are not aligned with the dots of the data to be printed. Thereby, additional time is spent on filling the blank dots, which causes the increase of the dots to be printed, and thus a memory of a larger capacity is required to store the data.

SUMMARY OF THE INVENTION

The present invention is directed to providing a printing method, which is used to perform a full-hole jet printing by aligning all the nozzles of a printing head with dots of a data to be printed.

The present invention provides a printing method, which comprises: providing a printing head having a plurality of nozzles arranged in a row in an arrangement direction, wherein the distance between any two neighboring nozzles is P; increasing the resolution of a data to be printed, such that a distance between the dots of the data to be printed in a first direction is X1, a distance between the dots of the data to be printed in a second direction perpendicular to the first direction is Y1; rotating the printing head, such that an angle $\theta$ exists between the arrangement direction and the second direction, $P \times \sin\theta$ is substantially an integral multiples of X1, and $P \times \cos\theta$ is substantially an integral multiples of Y1; and printing with the rotated printing head.

In view of the above, in the printing method of the present invention, the printing head performs a full-hole jet printing, so as to shorten the printing time and reduce the data processing amount.

In order to make the aforementioned and other objectives, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIGS. 2A-2C are a conventional microdeposition system, wherein FIG. 2A is a pattern to be formed, FIG. 2B is a predetermined jet printing position of a printing head according to nozzles, and FIG. 2C is the jet printing of the printing head according to a mask generated by a mask generating device.

DESCRIPTION OF EMBODIMENTS

The printing method of the present invention is used in a common document printing, i.e., printing the ink on the paper. Alternatively, the printing method of the present invention is also used in the industrial manufacturing, such as the manufacturing of radio frequency identification (RFID), color filter substrate, thin film transistor substrate, polymer light emitting diode (PLED), and printed circuit board (PCB), that is, the material to be formed into predetermined pattern is printed on a glass substrate, a plastic substrate or a substrate of other materials. The printing method of the present invention is used to print various data to be printed such as characters or patterns, and the format of the pattern data to be printed is, for example, Gerber, TIFF, JPEG or others. Before being printed, the data to be printed can be converted into a matrix data.

Figure 1A:
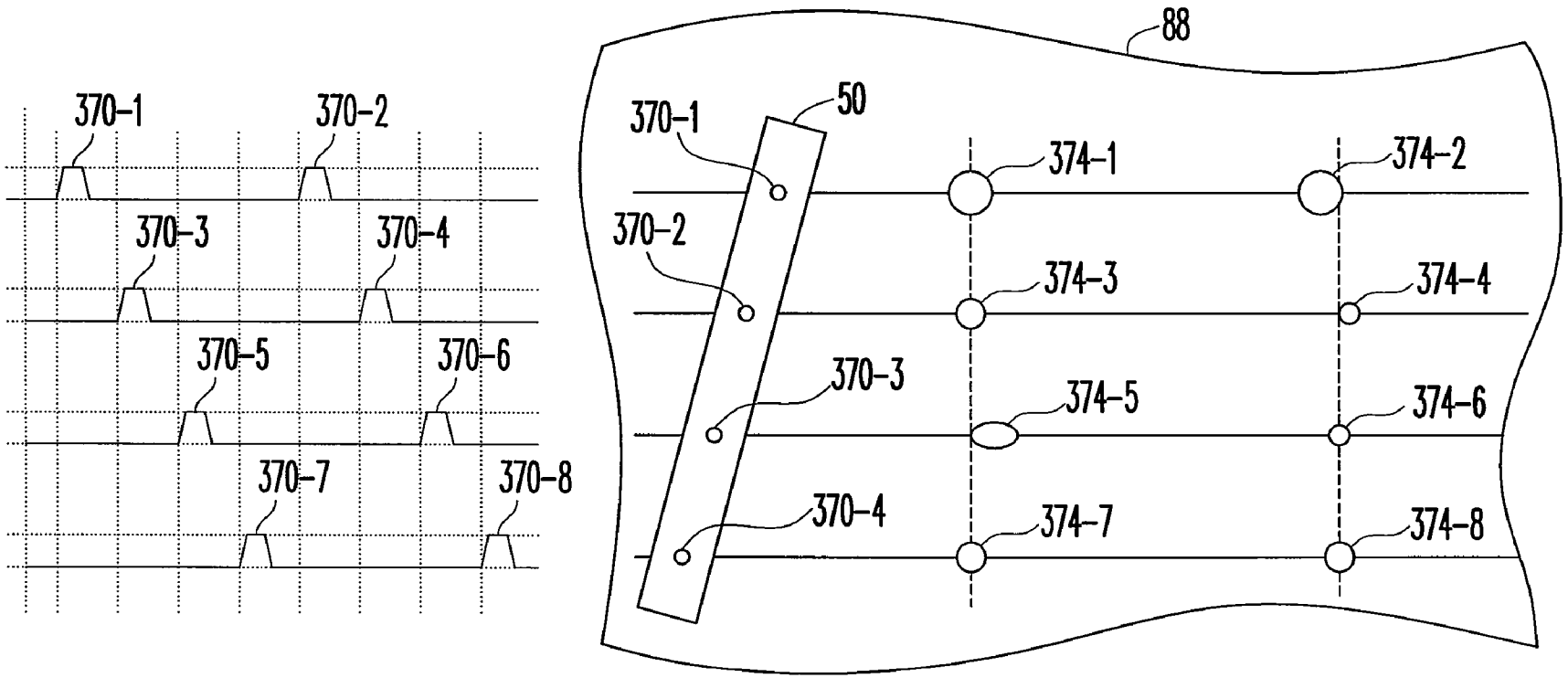
FIG. 1A(PRIOR ART)
FIGS. 1A-1B are schematic views for illustrating a conventional method for improving the printing quality of a microdeposition.
Figure 1B:
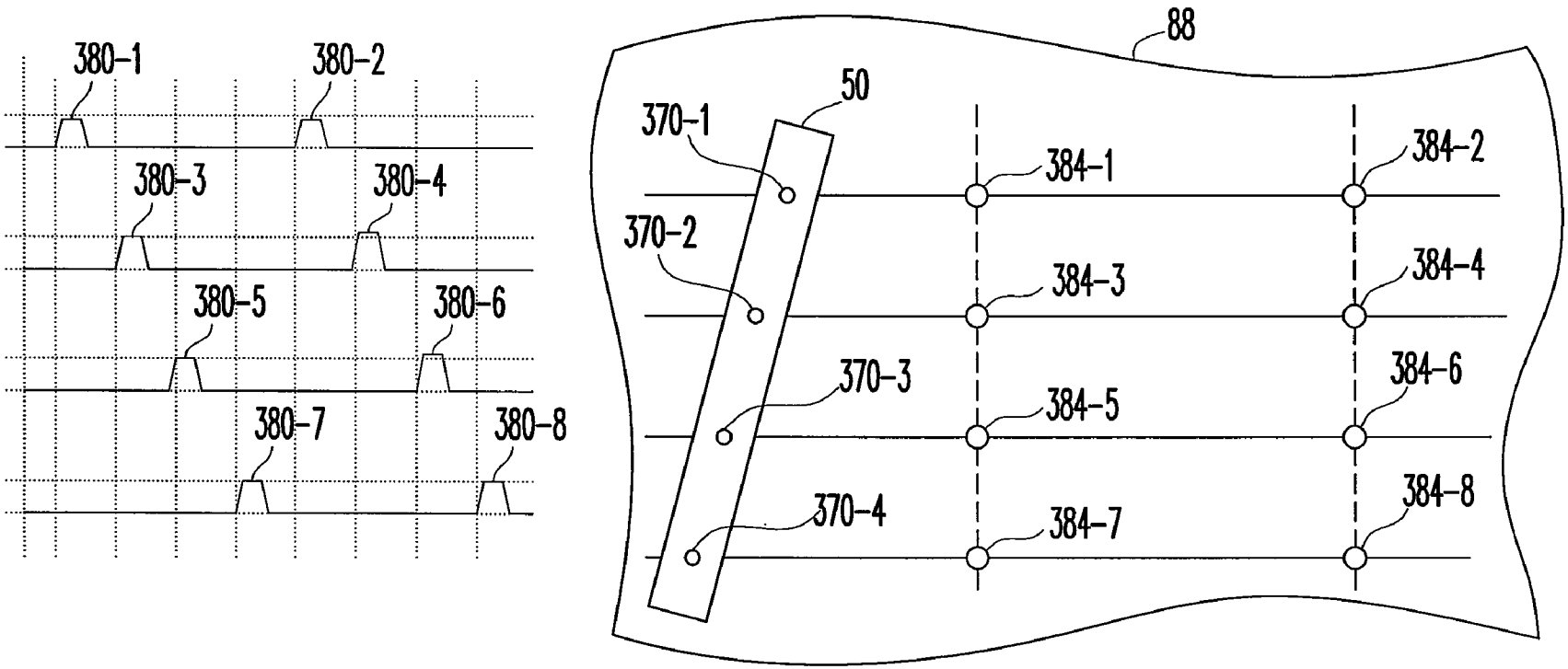
FIG. 1B(PRIOR ART)
Figure 2A:
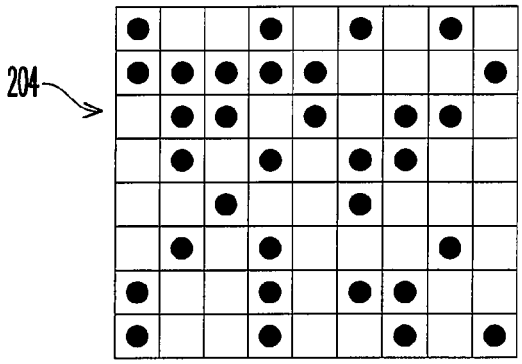
FIG. 2A(PRIOR ART)
Figure 2B:
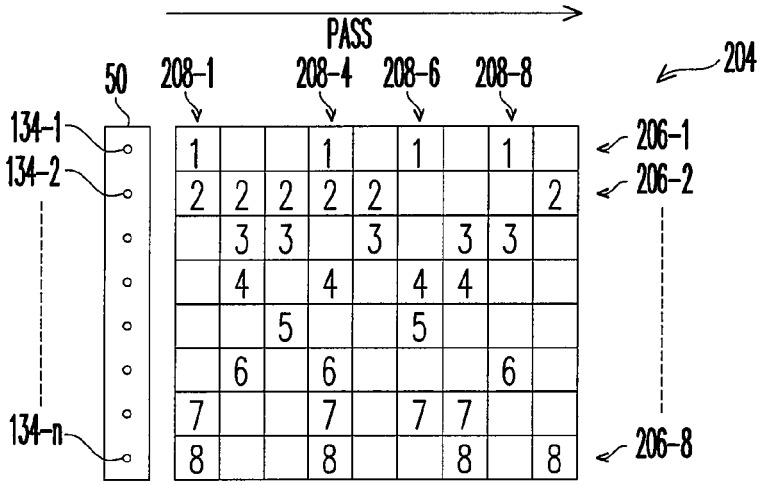
FIG. 2B(PRIOR ART)
Figure 2C:
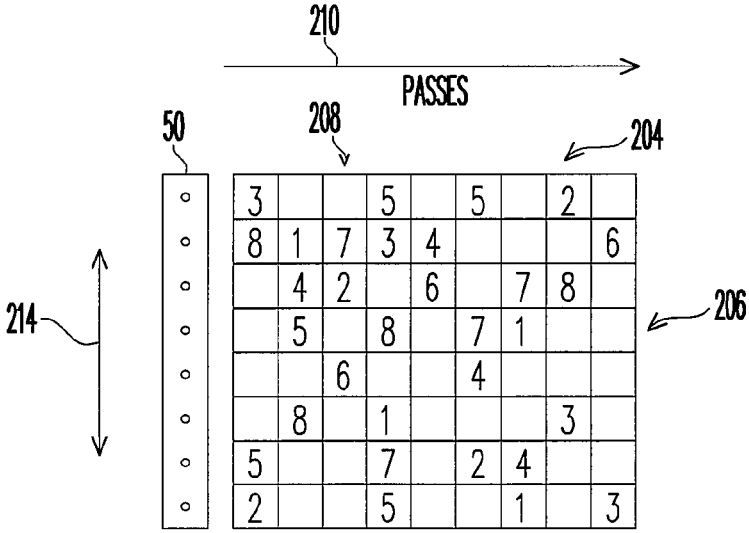
FIG. 2C(PRIOR ART)
Figure 3:
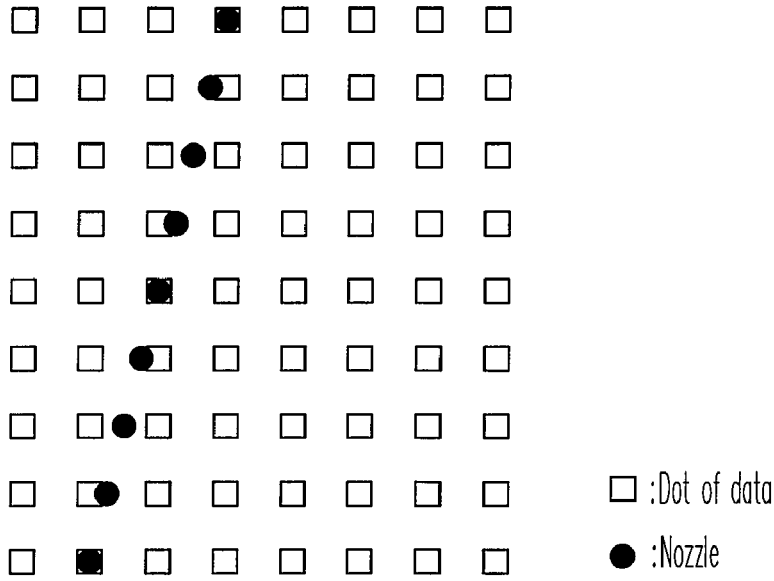
FIG. 3 (PRIOR ART)
FIG. 3 is a relative position of nozzles of the printing head and dots of the data to be printed according to a conventional printing method.
Figure 4:
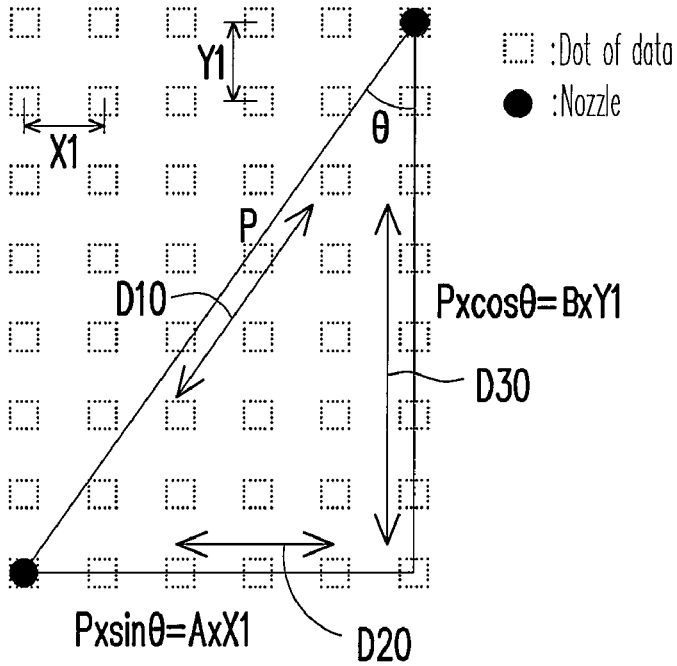
FIG. 4 is a printing method according to an embodiment of the present invention.

FIG. 4 is a printing method according to an embodiment of the present invention. The printing method of the present embodiment is utilizing a printing head to print a data to be printed on a substrate, especially when the resolution of the data to be printed is larger than that of the printing head, that is, when the distance between dots of the data to be printed is less than the distance between the nozzles of the printing head. Referring to FIG. 4, the printing head is provided with a plurality of nozzles (FIG. 4 only shows two of them) arranged in a row along an arrangement direction D10, and the distance between two neighboring nozzles is P. First, the printing head is rotated with an appropriate angle, such that all the nozzles are aligned with the dots of the data to be printed. Thereby, it is indicated that all the nozzles can be used to print when printing by the printing head (full-hole jet printing) without filling the blank dots to the non-aligned nozzles.

However, when some of the nozzles cannot be aligned with the dots of the data to be printed by only rotating the printing head, it is necessary to increase the resolution of the data to be printed properly. For example, the distance between the dots of the data to be printed in a first direction D20 is X0, and the distance between the dots in a second direction D30 perpendicular to the first direction D20 is Y0. After the resolution of the data to be printed is increased, the distance between the dots of the data to be printed in the first direction D20 is X1, and the distance between the dots in the second direction D30 is Y1, wherein $X1 \leqq X0$, $Y1 \leqq Y0$. If the resolution of the data to be printed is not adjusted, it indicates that $X1=X0$, $Y1=Y0$. Meanwhile, if the angle between the above arrangement direction D10 and the second direction D30 is θ after the printing head is rotated, it should be satisfied that $P \times \sin\theta$ is substantially an integral multiples of X1, and $P \times \cos\theta$ is substantially an integral multiples of Y1. In a preferred embodiment, $0° \leqq \theta \leqq 90°$. When the relationship of P, θ, X1 and Y1 satisfies the above requirements, it indicates that all the nozzles are aligned with the dots of the data to be printed. Then, the rotated printing head is used to print.

In one embodiment of the printing method, the angle θ is determined by the following method. First, from an initial angle of θ, a $(P \times \cos\theta)/Y0$ is calculated at every an interval of a predetermined angle to obtain a plurality of quotients B which must be positive integers. When the initial angle is 0°, θ=0°, 0.01°, 0.02°, . . . , 89.99° are respectively substituted into $(P \times \cos\theta)/Y0$, and the quotients being positive integers are picked out and the θ satisfying the condition and the corresponding B are recorded. That is, when the angle between the arrangement direction D10 and the second direction D30 is the θ being picked out, each nozzle at least is aligned with a row of horizontally arranged dots, but not all the nozzles are aligned with a column of perpendicularly arranged dots. Therefore, the next step is making all the nozzles be aligned with a column of perpendicularly arranged dots. Herein, 0.01° is taken as an example of the predetermined angle, which is not used to limit the present invention, and the rotating accuracy of the printing head is taken into account when selecting the predetermined angle.

In this step, the θ picked out in the former step are substituted into $(P \times \sin\theta)/X0$ respectively to obtain a plurality of quotients A0. Then, the quotients A0 are rounded up into positive integers unconditionally to obtain a plurality of quotients A. Then, the quotients A and the θ corresponding to the corresponding quotients A0 are substituted into $(P \times \sin\theta)/A$ respectively to obtain a plurality of distances X2 to be selected. That is, if the distance between the dots of the data to be printed in the first direction D20 is adjusted to the above distance X2 to be selected, all the nozzles are aligned with a column of perpendicularly arranged dots. However, in order to obtain a printing result closest to the data to be printed and reduce the data amount added for increasing the resolution, the one closest to X0 in the distances X2 to be selected is further selected, and the θ corresponding to the selected one in the distances X2 to be selected is the most preferable angle θ between the arrangement direction D10 and the second direction D30. Meanwhile, the distance X1 between the dots of the data to be printed in the first direction D20 must be adjusted to the above selected distance X2. Moreover, it is not necessary to adjust the distance between the dots of the data to be printed in the second direction D30, i.e., $Y1=Y0$. Definitely, the sequence of the above calculating steps can be adjusted appropriately according to the practical demand.

In the above method for determining the angle θ, it is not required that the data to be printed has the same resolution in the first direction D20 and in the second direction D30, but only the resolution of the data to be printed in the first direction D20 is adjusted. Hereinafter, a method of determining the angle θ is introduced under the limitation that the data to be printed has the same resolution in the first direction D20 and in the second direction D30.

First, from an initial angle of θ, a (P×sin θ)/X0 is calculated at every an interval of a predetermined angle to obtain a plurality of quotients A0. The predetermined angle is, for example, 0.01°, and the initial angle is, for example, 0°, which are not used to limit the present invention. Then, the quotients A0 are rounded up into positive integers unconditionally to obtain a plurality of quotients A, that is, the quotients A are positive integers. Then, the quotients A and the θ corresponding to the corresponding quotients A0 are substituted into (P×sin θ)/A respectively to obtain a plurality of distances X2 to be selected. Then, the data to be printed is set to have the same resolution in the first direction D20 and the second direction D30, thus the distances X2 to be selected and the corresponding θ are respectively substituted into (P×cos θ)/X2 to obtain a plurality of quotients B0. The positive integer closest to each quotient B0 is assumed as B.

Herein, it is assumed that the printing head moves with respect to the substrate along a direction parallel to the first direction D20, and after printing multiple rows of dots, the printing head moves with respect to the substrate along a direction parallel to the second direction D30, so that the printing head continues to print other rows of the dots. For being limited by the factors such as the moving accuracy of mechanism and the scale of optical scale, a certain error exists when the printing head moves with respect to the substrate along the direction parallel to the second direction D30. Therefore, even if the quotients B0 are not positive integers, when the quotients B0 conform to the principle that |(B0−B)×X2−X2| is smaller than or equal to an allowable distance error, the distances X2 to be selected corresponding to the quotients B0 are taken into account. The allowable distance error is an allowable error of two neighboring nozzles in the second direction D30.

Finally, the one closest to X0 in the distances X2 to be selected which are picked out and taken into account according to the above principle is selected as X1, and Y1=X1. Therefore, the θ corresponding to the selected X2 is the angle θ between the arrangement direction D10 and the second direction D30.

Two methods for determining the most preferable angle θ between the arrangement direction D10 and the second direction D30 are introduced as above. Hereinafter, in the printing method of the present invention, a method of moving the printing head when printing and a corresponding process on dots are introduced.

Figure 5:
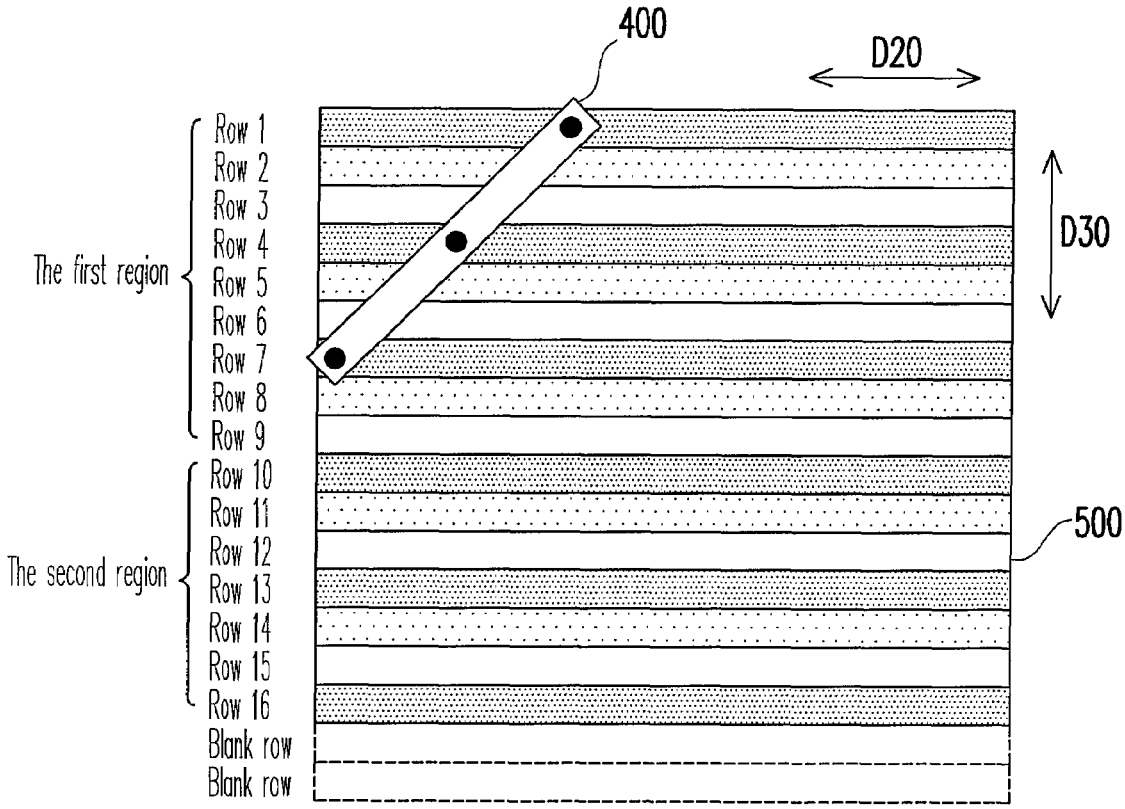
FIG. 5 is a schematic view of a relative relationship between a data to be printed and a printing head in a printing method according to an embodiment of the present invention.

FIG. 5 is a schematic view of a relative relationship between a data to be printed and a printing head in a printing method according to an embodiment of the present invention. Referring to FIG. 5, when the printing head 400 is rotated with an appropriate angle, the data to be printed 500 is divided into a plurality of blocks, and being divided into a first block and a second block is taken as an example herein. Then, the printing is performed on the blocks one by one, i.e., the printing head 400 performs the printing on the second block after finishing the printing on the first block. Herein, it is assumed that the printing head moves with respect to the substrate along a direction parallel to the first direction D20 to accomplish the printing on the first block, and the printing head moves with respect to the substrate along a direction parallel to the second direction D30 to perform the printing on the second block.

Moreover, in each block, multiple interlace printings are performed. More specifically, if (P×cos θ)/Y1=B, and B is a positive integer, the printing head performs the interlace printing for B times in each block, wherein each symbol represents the meaning as the above. For example, in FIG. 4, the printing head needs to perform the printing for 7 times in one block. For example, in FIG. 5, the printing head needs to perform the printing for 3 times in one block.

Referring to FIG. 5 again, it is assumed that the number of used nozzles is N (N=3 in FIG. 5), wherein N is a positive integer. In each block, the dots of the data to be printed are arranged in N×B rows in a direction parallel to the first direction D20, wherein B=3 in FIG. 5. At this point, in the first block, the dots in rows (1+(1−1)×B), (1+(2−1)×B), . . . , (1+(N−1)×B) are printed by the printing head 400 for the first time, i.e., rows 1, 4 and 7. The dots in rows (2+(2−1)×B), (2+(2−1)×B), . . . , (2+(N−1)×B) are printed by the printing head 400 for the second time, i.e., rows 2, 5 and 8. The dots in rows (3+(3−1)×B), (3+(3−1)×B), . . . , (3+(N−1)×B) are printed by the printing head 400 for the third time, i.e., rows 3, 6 and 9. According to the regulation, the dots in rows (B+(3−1)×B), (B+(3−1)×B), . . . , (B+(N−1)×B) are printed by the printing head 400 for the $B^{th}$ time.

After the first block is printed, the second block is printed according to the same regulation. For example in FIG. 5, in the second block, rows 10, 13 and 16 are printed by the printing head 400 for the first time, rows 11, 14 and 17 are printed by the printing head 400 for the second time, and rows 12, 15 and 18 are printed by the printing head 400 for the third time. Notably, since the data to be printed 500 in FIG. 5 only has 16 rows of data, the above rows 17 and 18 are virtually filled with blank rows.

One embodiment of a method for determining the number of blank rows to be filled is given below. If the number of the used nozzles is N (N=3 in FIG. 5), the dots of the data to be printed 500 are arranged in M rows (M=16 in FIG. 5) along a direction parallel to the first direction D20. When M/(N×B) has a residue R, blank dots of ((N×B)−R) rows are filled in the data to be printed. For example in FIG. 5, B=3 and R=7, thus the number of the blank rows to be filled is 2. The above N, M and R are positive integers.

It should be noted that, the printing head 400 is designed to automatically detect the performance information of each nozzle before printing, and stop using the nozzles of poor performance by the way of, for example, filling with blank dots. Moreover, the step of filling with the blank rows aims to correspond the nozzles to the dots corresponding to the blank rows, so as to drive the corresponding nozzle to stop printing.

Figure 6:
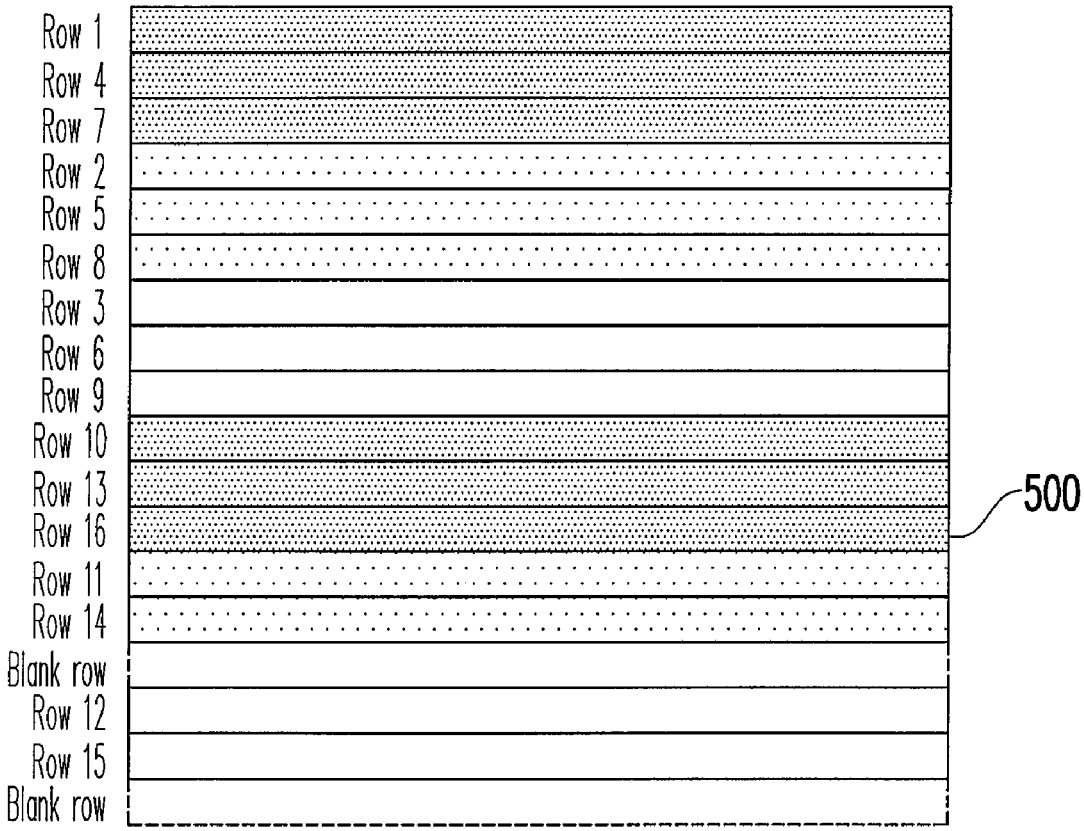
FIG. 6 is a schematic view of the data to be printed in FIG. 5 after being rearranged.

FIG. 6 is a schematic view of the data to be printed in FIG. 5 after being rearranged. Referring to FIGS. 5 and 6, before the interlace printing, the dots of the data to be printed 500 in each block are rearranged in the sequence of the interlace printing. After that, the rearranged data to be printed 500 are sequentially stored into a memory of a printing device for being read to use when printing.

Moreover, it is found from FIG. 5 that, since the printing head 400 is rotated with an appropriate angle, when each row of dots is printed, it is commonly found that a part of nozzles are aligned with the dots to print, but a part of nozzles are not aligned with the dots. Likewise, as soon as the printing of each row of dots is finished, it also can be found that a part of the nozzles are not aligned with any dots after finishing the printing of a whole row of the dots, but a part of nozzles has not finished the printing of the whole row of the dots. In the above two situations, the blank dots are filled to the nozzles which have not entered or have left the region having the data to be printed distributed thereon, so as to drive the nozzles to stop printing.

In view of the above, in the printing method of the present invention, the printing head is rotated and the resolution of the data to be printed is increased, such that all the nozzles of the printing head are aligned with the dots of the data to be printed. Thereby, the printing head performs a full-hole jet printing, thus improving the efficiency of printing and shortening the printing time. Moreover, since all the nozzles are aligned with the dots of the data to be printed, a large amount of blank dots are not required to be filled in, thus saving the time for filling with blank dots and the space of memory, and reducing the cost of allocating a memory of a high capacity.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims and their equivalents.

What is claimed is:

1. A printing method, comprising:

providing a printing head having a plurality of nozzles arranged in a row in an arrangement direction, wherein the distance between any two neighboring nozzles is P;

determining an angle θ that makes (P×cos θ)/YO and (P×sin θ)/XO both be closest to positive integers by calculating (P×cos θ)/YO and (P×sin θ)/XO at every an interval of a predetermined angle from an initial angle of θ, wherein the distance between the dots of a data to be printed in the first direction is X0, and the distance between the dots of the data to be printed in the second direction perpendicular to the first direction is Y0;

increasing the resolution of the data to be printed, such that a distance between the dots of the data to be printed with increased resolution in the first direction is X1, and a distance between the dots of the data to be printed with increased resolution in the second direction is Y1;

rotating the printing head, such that an angle exists between the arrangement direction and the second direction is the determined angle θ, P×sin θ is substantially an integral multiples of X1, and P×cos θ is substantially an integral multiples of Y1; and printing with the rotated printing head.

2. The printing method as claimed in claim 1, wherein 0°≦θ<90°.

3. The printing method as claimed in claim 1, wherein X1≦X0, Y1≦Y0, and the method for determining the angle θ comprises:

from the initial angle of θ, calculating (P×cos θ)/Y0 at every an interval of the predetermined angle to obtain a plurality of quotients B which must be positive integers;

substituting the θ corresponding to the quotients B into (P×sin θ)/X0 respectively to obtain a plurality of quotients A0;

rounding up the quotients A0 into positive integers unconditionally to obtain a plurality of quotients A;

substituting the quotients A and the θ corresponding to the corresponding quotients A0 into (P×sin θ)/A respectively to obtain a plurality of distances X2 to be selected; and selecting the θ corresponding to the one closest to X0 in the distances X2 to be selected as the angle θ.

4. The printing method as claimed in claim 3, wherein the predetermined angle is 0.01°.

5. The printing method as claimed in claim 3, wherein the initial angle is 0°.

6. The printing method as claimed in claim 1, wherein X1=Y1≦X0=Y0, and the method for determining the angle θ comprises:

from the initial angle of θ, calculating (P×sin θ)/X0 at every an interval of the predetermined angle to obtain a plurality of quotients A0;

rounding up the quotients A0 into positive integers unconditionally to obtain a plurality of quotients A;

substituting the quotients A and the corresponding θ into (P×sin θ)/A respectively to obtain a plurality of distances X2 to be selected; and selecting the θ corresponding to the one closest to X0 in the obtained distances X2 to be selected as the angle θ.

7. The printing method as claimed in claim 6, wherein selecting the θ corresponding to the one closest to X0 in the obtained distances X2 to be selected as the angle θ comprises:

substituting the distances X2 to be selected respectively into (P×cos θ)/X2 to obtain a plurality of quotients B0;

taking the distances X2 to be selected corresponding to the quotients B0 which conform to the principle that |(B0−B)×X2-X2| is smaller than or equal to an allowable error of distance into account, wherein B is a positive integer being closest to the corresponding quotient B0; and selecting the θ corresponding to the one closest to X0 in the considered distances X2 to be selected as the angle θ.

8. The printing method as claimed in claim 6, wherein the predetermined angle is 0.01°.

9. The printing method as claimed in claim 6, wherein the initial angle is 0°.

10. The printing method as claimed in claim 1, wherein the printing direction of the printing head is parallel to the first direction.

11. The printing method as claimed in claim 1, wherein the data to be printed is a matrix data converted from an image file with a format of Gerber, TIFF or JPEG.

12. The printing method as claimed in claim 1, wherein after rotating the printing head and before the printing, the data to be printed is further divided into a plurality of blocks, and the printing is performed on the blocks one by one.

13. The printing method as claimed in claim 12, wherein multiple interlace printings are performed in each of the blocks.

14. The printing method as claimed in claim 13, wherein (P×cos θ)/Y1=B, B is a positive integer, and the printing head performs the interlace printing for B times in each of the blocks.

15. The printing method as claimed in claim 14, wherein the number of the used nozzles is N, N is a positive integer, the dots of the data to be printed in each of the blocks are arranged in N×B rows along a direction parallel to the first direction, and the dots in rows (1+(1−1)×B), (1−(2−1)×B), . . . , (1+(N−1)×B) are printed by the printing head for the first time, the dots in rows (2+(1−1)×B), (2+(2−1)×B), . . . , (2+(N−1)×B) are printed by the printing head for the second time, . . . , and the dots in rows (B+(1−1)×B), (B+(2−1)×B), . . . , (B+(N−1)×B) are printed by the printing head for the Bth time.

16. The printing method as claimed in claim 14, wherein the number of used nozzles is N, the dots of the data to be printed are arranged in M rows along a direction parallel to the first direction, when M/(N×B) has a residue R, blank dots of ((N×B)−R) rows are further filled in the data to be printed, wherein N, M and R are positive integers.

17. The printing method as claimed in claim 13, wherein before the interlace printing, the dots of the data to be printed in each of the blocks are further rearranged in the sequence of the interlace printing.

18. The printing method as claimed in claim 1, wherein when printing, blank dots are filled to the nozzles which have not entered or have left a region having the data to be printed distributed thereon.

19. The printing method as claimed in claim 1, wherein after rotating the printing head and before the printing, invalid nozzles of the nozzles are detected and blank dots are filled to the invalid nozzles.

* * * * *